US011064805B1

(12) United States Patent
Berkin-Harper

(10) Patent No.: US 11,064,805 B1
(45) Date of Patent: Jul. 20, 2021

(54) MODULAR ADJUSTABLE TABLE

(71) Applicant: Street Lab, Inc., Brooklyn, NY (US)

(72) Inventor: Hannah Berkin-Harper, Brooklyn, NY (US)

(73) Assignee: Street Lab, Inc., Brooklyn, NY (US)

( * ) Notice: Subject to any disclaimer, the term of this patent is extended or adjusted under 35 U.S.C. 154(b) by 0 days.

(21) Appl. No.: 16/886,392

(22) Filed: May 28, 2020

(51) Int. Cl.

| | |
|---|---|
| ***A47B 87/00*** | (2006.01) |
| ***A47B 3/06*** | (2006.01) |
| ***A47B 13/00*** | (2006.01) |
| ***A47B 13/10*** | (2006.01) |
| ***A47B 13/04*** | (2006.01) |

(52) U.S. Cl.
CPC ..... *A47B 87/002* (2013.01); *A47B 3/06* (2013.01); *A47B 13/003* (2013.01); *A47B 13/04* (2013.01); *A47B 13/10* (2013.01); *A47B 2200/0003* (2013.01); *A47B 2200/0017* (2013.01)

(58) Field of Classification Search
CPC ..... A47B 3/06; A47B 2220/0086
USPC .... 108/180, 157.14, 12, 19, 157.16, 157.18, 108/157.19, 165, 159
See application file for complete search history.

(56) References Cited

U.S. PATENT DOCUMENTS 1,940,117 A * 12/1933 Carpos ..... A47B 3/06 108/157.18
2,054,098 A * 9/1936 Rich ..... A47B 23/001 108/1
2,546,812 A * 3/1951 Anderson ..... A47B 3/06 108/25
2,615,771 A * 10/1952 Curtis ..... A47B 13/003 108/159
3,338,189 A * 8/1967 Xavier ..... A47C 4/03 108/183
4,106,413 A * 8/1978 Hoaglund ..... A47B 9/16 108/12
4,191,113 A * 3/1980 Hogberg ..... A47C 4/021 108/157.16
6,427,604 B1 * 8/2002 Chrobak ..... A47B 9/00 108/12
6,443,076 B1 * 9/2002 Case, Jr. ..... A47B 3/14 108/157.18
6,619,749 B2 * 9/2003 Willy ..... A47B 3/06 297/440.13
6,807,912 B2 * 10/2004 Willy ..... A47B 3/06 108/157.14
6,846,043 B1 * 1/2005 Leoutsakos ..... A47C 16/025 108/147.11

(Continued)

FOREIGN PATENT DOCUMENTS

AT 11947 U1 * 8/2011 ..... F16B 12/48
WO WO-0003147 A1 * 1/2000 ..... A47B 47/04

OTHER PUBLICATIONS

Hannah Berkin-Harper, U.S. Appl. No. 29/736,234, filed May 28, 2020 for "Table"; 29 pages.

*Primary Examiner* — Jose V Chen
(74) *Attorney, Agent, or Firm* — Morrison & Foerster LLP

(57) ABSTRACT

Disclosed herein are modular, height adjustable tables that can be quickly assembled and disassembled without the use of tools. Furthermore, the modular tables disclosed herein can be easily transported due to their lightweight and quick assembly and disassembly process. In addition, the assembly and disassembly process of the tables disclosed herein may not require anything outside of a table top and table legs.

17 Claims, 10 Drawing Sheets

(56) References Cited

U.S. PATENT DOCUMENTS

| | | | | |
|---|---|---|---|---|
| D744,773 | S | 12/2015 | Yoon | |
| 9,651,191 | B1 * | 5/2017 | Grisham | F24B 3/00 |
| 10,610,011 | B1 * | 4/2020 | Greenhill | A47B 23/043 |
| 2004/0055515 | A1 * | 3/2004 | Chen | A47B 13/00 108/157.14 |
| 2008/0245281 | A1 * | 10/2008 | Willy | A47B 13/003 108/157.16 |
| 2018/0035799 | A1 * | 2/2018 | Leafgren | A47B 23/00 |
| 2021/0037663 | A1 * | 2/2021 | Davidson | A47B 21/04 |

* cited by examiner

MODULAR ADJUSTABLE TABLE

FIELD OF THE DISCLOSURE

This invention relates generally to tables, and more specifically, to modular tables that are height-adjustable and quickly assembled and disassembled.

BACKGROUND OF THE DISCLOSURE

Tables with an adjustable height functionality are known. However, such height adjustable tables typically are heavy, bulky, take up a large footprint, have many assembly pieces and/or require tools (such as screwdrivers, hammers, drills, etc.) for assembly or disassembly of the table. Thus, typical height adjustable tables are not suitable for use in settings where frequent moving and/or frequent assembly/disassembly is commonplace. One such setting is an outdoor public space.

Outdoor public spaces can be used for educating the public. For example, various pop-up reading rooms and/or open-air drawing studios can sporadically show up in an outdoor public space for public educational purposes. It is often the case, that these popup or open-air educational events are geared towards children. Such educational children events may utilize mobile furniture such as a mobile shelf for storing books or learning supplies for the children to use and access. However, the mobile furniture for outdoor public spaces typically has a fixed height for use by children or adults, but not both.

SUMMARY OF THE DISCLOSURE

Applicants have discovered modular, height adjustable tables that can be quickly assembled and disassembled without the use of tools. Furthermore, the modular tables disclosed herein can be easily transported due to their lightweight and quick assembly and disassembly process. In addition, the assembly and disassembly process of the tables disclosed herein may not require anything outside of a table top and table legs.

In some embodiments, a table includes: a top including a plurality of apertures; and a plurality of legs, each leg including: a first side including a first protrusion and a first slot; a second side including a second protrusion and a second slot; and a third side including a third slot and a fourth slot, wherein: when the table is in a first configuration, the first protrusion of each leg engages with one aperture of the plurality of apertures of the top and the first slot of each leg engages with the third slot of another leg, and when the table is in a second configuration, the second protrusion of each leg engages with one aperture of the plurality of apertures of the top and the second slot of each leg engages with the fourth slot of another leg, wherein the table has a first height in the first configuration and a second height in the second configuration.

In any of these embodiments, the top may include a first surface and a second surface, and the plurality of apertures may extend from the first surface to the second surface through the top.

In any of these embodiments, in the first configuration, the first protrusion of each leg may extend through one aperture of the plurality of apertures from the first surface to the second surface of the top.

In any of these embodiments, in the second configuration, the second protrusion of each leg may extend through one aperture of the plurality of apertures from the first surface to the second surface of the top.

In any of these embodiments, the first slot and the second slot may extend towards the third side, the second slot may extend towards the third side, the third slot may extend towards the first side, and the fourth slot may extend towards the second side.

In any of these embodiments, the first slot may extend from the first side in a direction perpendicular to the first side, the second slot may extend from the second side in a direction perpendicular to the second side, the third slot may extend from the third side in a direction perpendicular to the first side, and the fourth slot may extend from the third side in a direction perpendicular to the second side.

In any of these embodiments, the plurality of apertures may include a number of apertures and the plurality of legs may include a number of legs equal to the number of apertures.

In any of these embodiments, the top may have a triangular shape.

In any of these embodiments, the apertures of the plurality of apertures may be identical in shape and size.

In any of these embodiments, the plurality of apertures may include three apertures.

In any of these embodiments, the legs of the plurality of legs may have a triangular shape.

In any of these embodiments, the plurality of legs may include three legs.

In any of these embodiments, the legs of the plurality of legs may be identical in shape and size.

In any of these embodiments, the top may be plywood.

In some embodiments, a table system includes a plurality of tables, each table including: a top including a plurality of apertures; and a plurality of legs, each leg including: a first side including a first protrusion and a first slot; a second side including a second protrusion and a second slot; and a third side including a third slot and a fourth slot, wherein: when the table is in a first configuration, the first protrusion of each leg engages one aperture of the plurality of apertures of the first top and the first slot of each leg engages the third slot of another leg, and when the table is in a second configuration, the second protrusion of each leg engages one aperture of the plurality of apertures of the first top and the second slot of each leg engages the fourth slot of another leg, wherein the table has a first height in the first configuration and a second height in the second configuration.

In any of these embodiments, each top of the plurality of tables may include a first shape, wherein the first shape is circular, triangular, rectangular, or another polygonal shape.

In any of these embodiments, the table system may be configured to form a second shape based on the first shape and an orientation of each top of the plurality of tables.

In addition, it is also to be understood that the singular forms "a", "an," and "the" used in the following description are intended to include the plural forms as well, unless the context clearly indicates otherwise. It is also to be understood that the term "and/or," as used herein, refers to and encompasses any and all possible combinations of one or more of the associated listed items. It is further to be understood that the terms "includes," "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

BRIEF DESCRIPTION OF THE FIGURES

The invention will now be described, by way of example only, with reference to the accompanying drawings, in which.

Like reference numbers in the different figures refer to the similar or same feature unless specifically stated herein.

DETAILED DESCRIPTION OF THE DISCLOSURE

According to some embodiments, the tables disclosed herein can be height adjustable by having a first configuration and a second configuration. In either configuration, the legs can engage each other to form a base of the table and a top can engage the base to form the table having a table height. The table height can be dependent on the how the legs are engaged. For example, in the first configuration, the legs may be engaged in an orientation for supporting the top at a first height and in the second configuration, the legs may be engaged in another orientation for supporting the top at a second height different from the first height. In some embodiments, the engagement, as well as the disengagement, of the legs and the table top may not require tools or equipment outside of the legs and the table top themselves. Therefore, the assembly and disassembly of the tables can be minimal and quick.

Figure 1B:
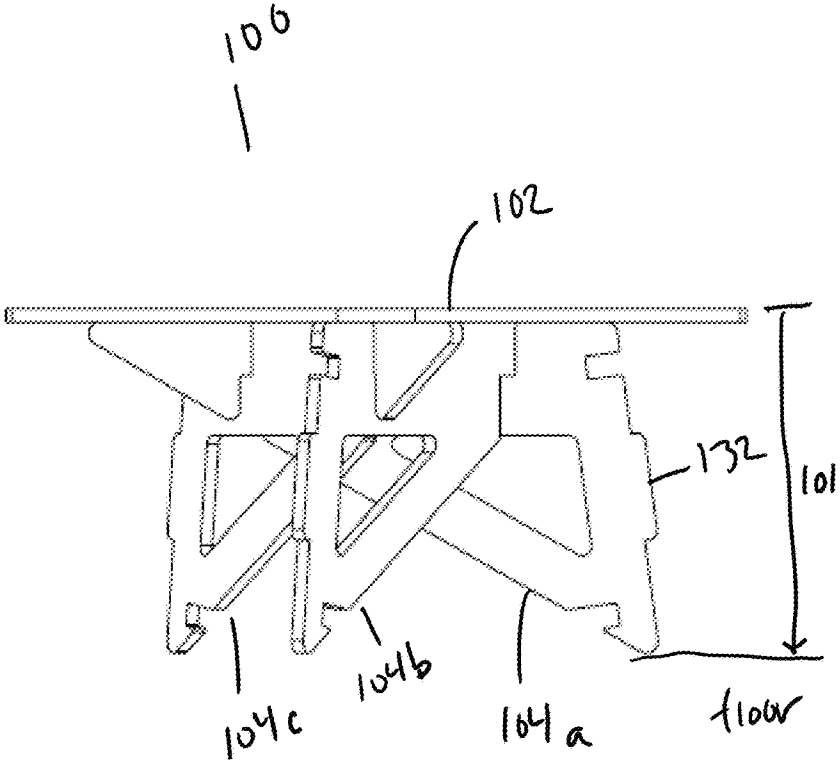
FIGS. 1A-B show side views of a table assembled in a first configuration according to some embodiments, FIGS. 2A-B respectively show a top perspective view and a bottom perspective of a table assembled in a first configuration according to some embodiments, FIGS. 3A-B respectively show a top planar view and a bottom planar view of a table assembled in a first configuration according to some embodiments.
Figure 1A:
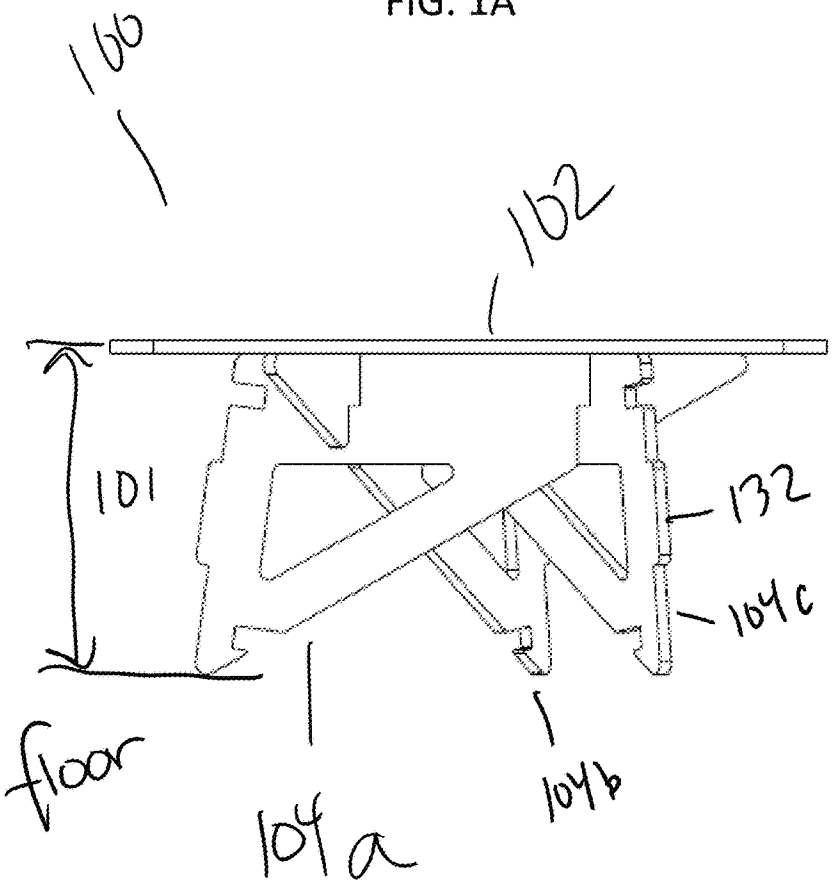
Figure 2B:
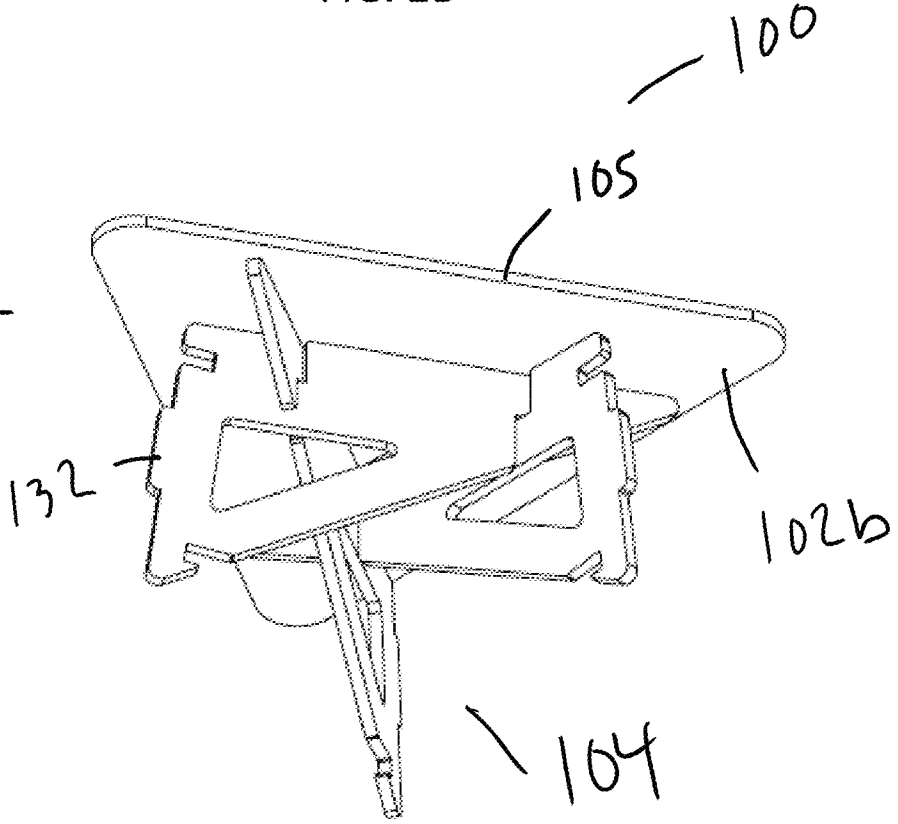
Figure 2A:
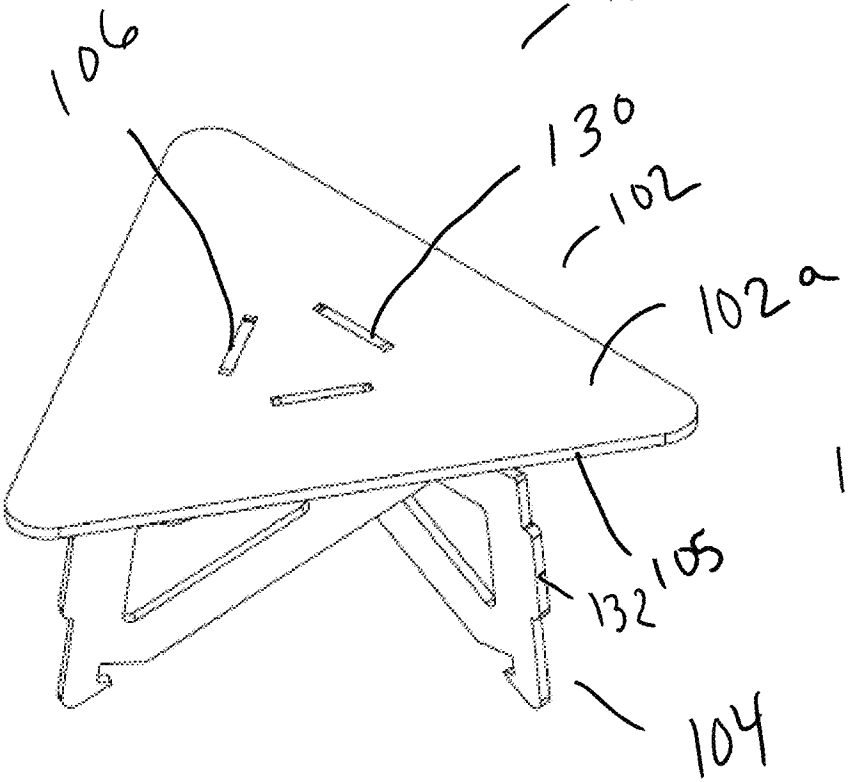
Figure 3B:
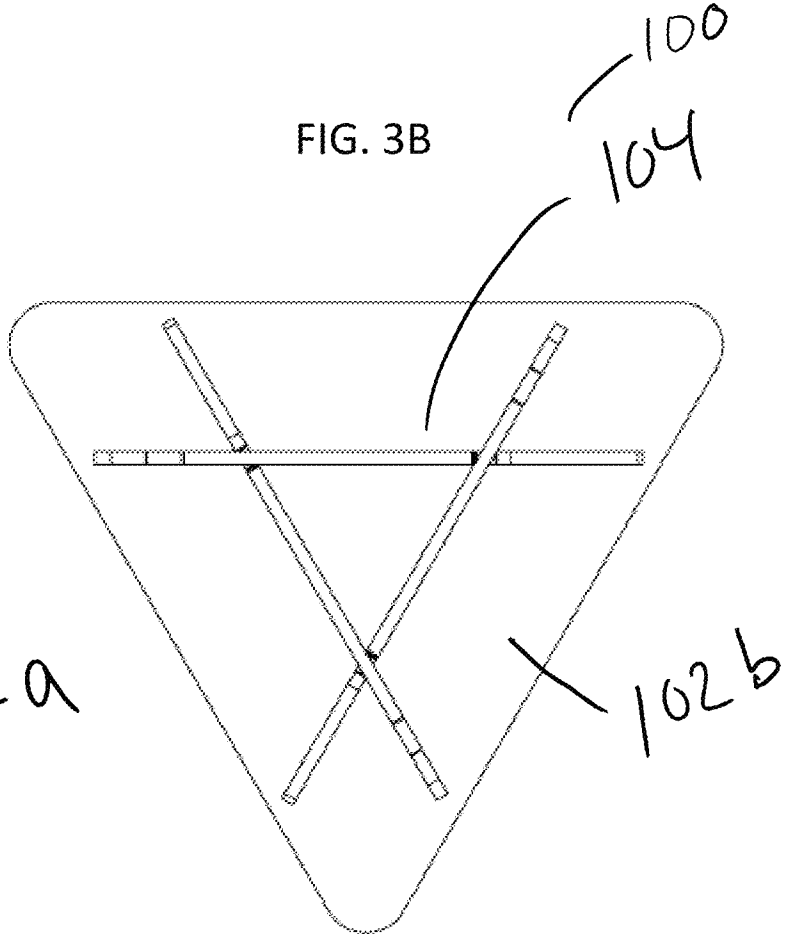
Figure 3A:
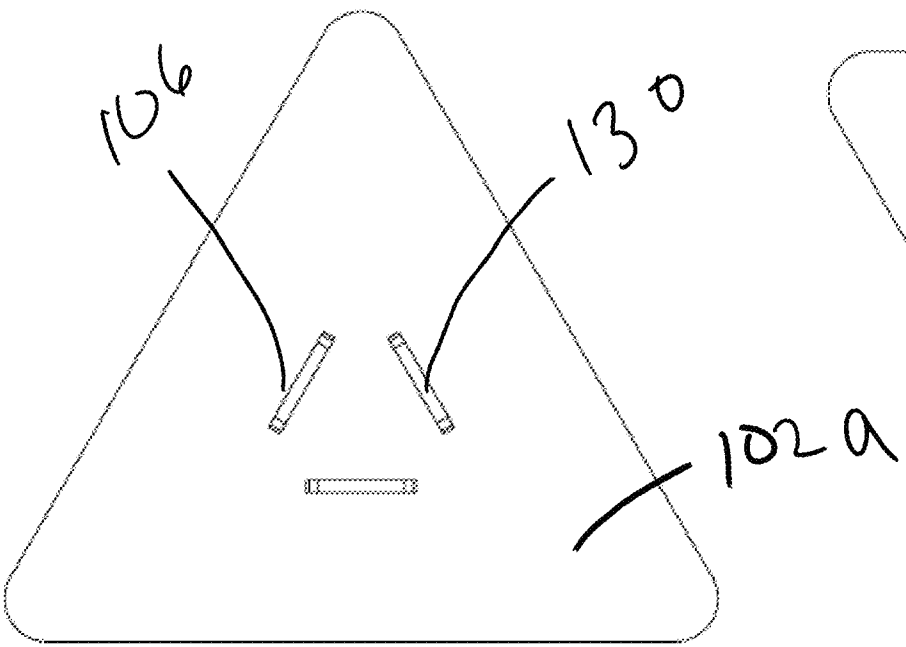
Figure 4:
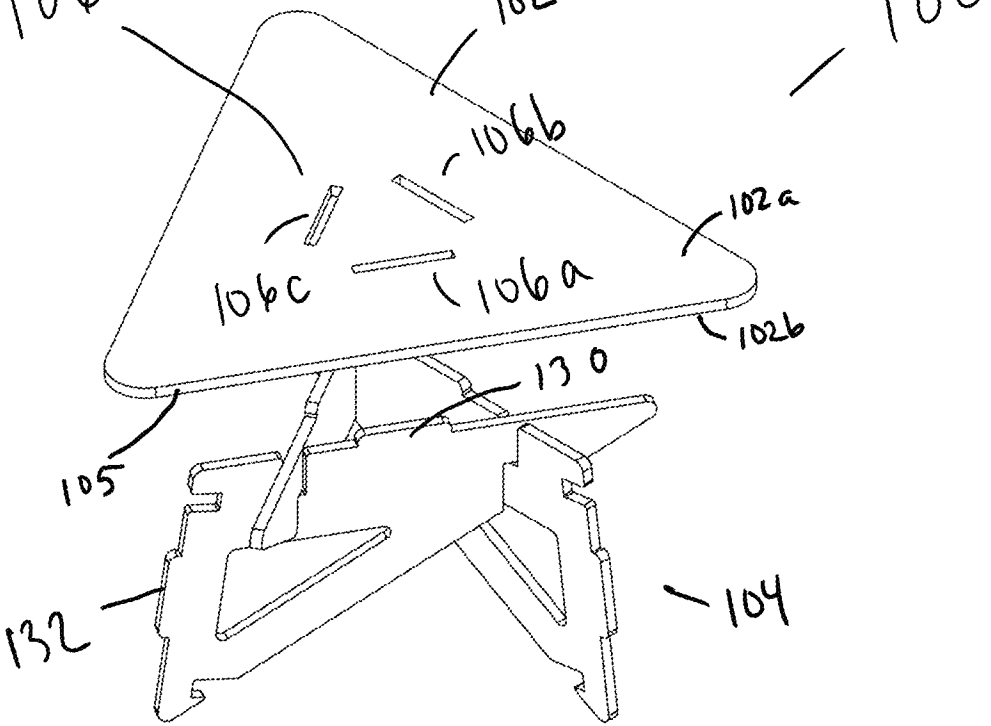
FIG. 4 shows a partial exploded view of a table in a first configuration.

The tables disclosed herein can have a top and a plurality of legs for supporting the top in a first configuration. For example, FIGS. 1-3 show different views of a table 100 with a top 102 and a plurality of legs 104 in a first configuration. In particular, FIGS. 1A and 1B show side views of table 100, FIGS. 2A and 2B respectively show top and bottom perspective views of table 100, and FIGS. 3A and 3B respectively show top and bottom planar views of table 100. In the first configuration, the plurality of legs 104 may include legs 104*a*, 104*b*, 104*c* that engage each other to form a base for supporting the table top 102 at a table height 101. The first table height 101 may be a distance between the table top 102 assembled onto the plurality of legs and a surface, such as a floor or ground, that supports the plurality of legs. The top 102 may be assembled onto and disassembled from the base formed by the plurality of legs 104. For example, FIG. 4 shows a partial exploded view of the table 100 in which the top 102 is separated from the base.

According to some embodiments, the top of the table can have any shape. The top can have a circular, triangular, rectangular, or any other shape. For example, FIGS. 2-4 show that the table top 102 has a triangular shape. The triangular shape may have a width extending from a first surface 102*a* to a second surface 102*b* opposite the first surface 102*a* and may have a plurality of sides 105 extending from one corner or vertex of the table top 102 to another corner of the table top 102. The corners may be formed by an intersection of two sides of the table top 102. In some embodiments, the corners may have a radius of curvature (i.e., rounded) that makes the table top 102 safe for use by children.

According to some embodiments, the top may have a triangular shape that has sides of equal length (i.e., an equilateral triangular shape). For example, sides 105 may have equal lengths. According to some embodiments, the sides 105 of the triangular table top may have a length of at least about 20 inches, about 25 inches, or about 30 inches. According to some embodiments, the sides of the triangular table top may have a length of at most about 55 inches, about 50 inches, or about 45 inches. According to some embodiments, the sides of the triangular table top may have a length of about 20-55 inches, about 25-50 inches, or about 30-45 inches. According to some embodiments, the sides 105 of the triangular top may be identical.

According to some embodiments, the top may be reversible to configure one or two surfaces as a working surface. For example, either surface 102*a* or 102*b* may be configured as a working surface depending on how the top 102 is mounted onto the plurality of legs 104. The surface that faces away from the legs may be configured as the designated working surface. That is, the top 102 may be mounted on the legs 104 such that either the first surface 102*a* or the second surface 102*b* face away from the legs as the working surface. According to some embodiments, the first surface 102*a* and second surface 102*b* of the table top 102 may be flat surfaces that are identical in shape and size.

According to some embodiments, the top may include a plurality of apertures for engaging the plurality of legs. The apertures may be spaced within the top to stabilize the top onto the plurality of legs. For example, the table top 102 may include a plurality of apertures 106 that are sized and spaced for engaging the plurality of legs 104. The plurality of apertures may include apertures 106*a*, 106*b*, and 106*c* that extend between the first surface 102*a* and the second surface 102*b* through the table top 102. The plurality of apertures 106 may form a triangular pattern in the table top 102 arranged to stabilize the top 102 onto the plurality of legs 104. In some embodiments, the plurality of apertures 106 may be arranged in a triangular shape that is geometrically similar to the triangular table top 102. The plurality of apertures 106 may include three or more apertures. According to some embodiments, the number of apertures 106 may equal the number of legs 104.

The plurality of apertures may be rectangular having a length, a width, and a depth configured to stabilize the top onto the plurality of legs. According to some embodiments, the length of apertures 106 may be at least about 3 inches, about 4 inches, or about 5 inches. According to some embodiments, the length of the apertures 106 may be at most about 9 inches, about 8 inches, or about 7 inches. According to some embodiments, the length of apertures 106 may be about 3-9 inches, about 5-8 inches, or about 5-7 inches. According to some embodiments, the width of the apertures 106 may be at least about 0.2 inches, about 0.4 inches, or about 0.6 inches. According to some embodiments, the width of the apertures 106 may be at most about 1.2 inches, about 1 inch, or about 0.8 inches. According to some embodiments, the width of the apertures 106 may be about 0.2-1.2 inches, about 0.4-1 inches, or about 0.6-0.8 inches. According to some embodiments, the depth of the apertures 106 may be at least about 0.2 inches, about 0.4 inches, or about 0.6 inches. According to some embodiments, the depth of the apertures 106 may be at most about 1.2 inches, about 1 inch, or about 0.8 inches. According to some embodiments, the depth of the apertures 106 may be about 0.2-1.2 inches, about 0.4-1 inches, or about 0.6-0.8 inches. In some embodiments, the plurality of apertures 106 may be identical in shape and size.

Figure 5:
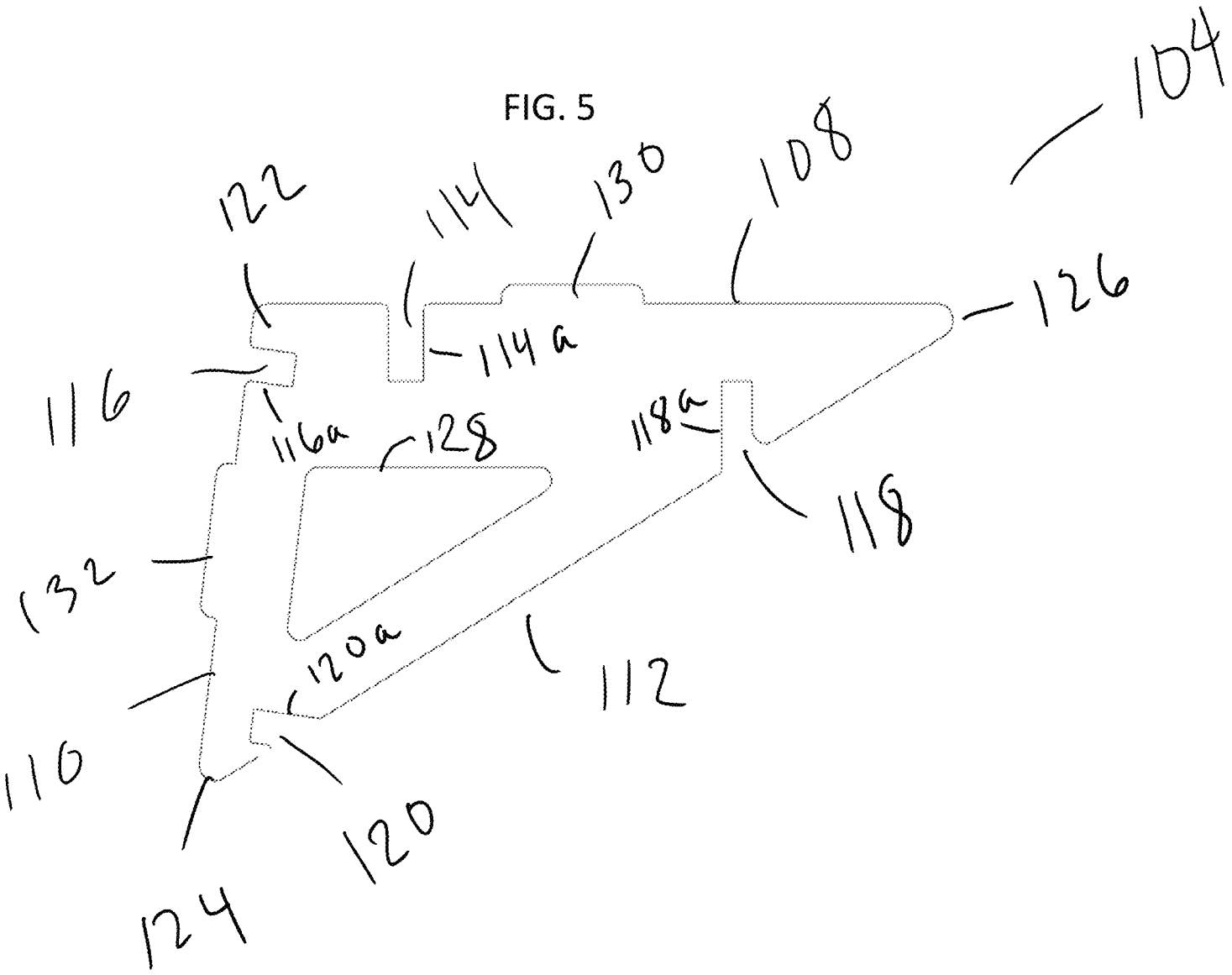
FIG. 5 shows a table leg according to some embodiments.

According to some embodiments, the plurality of legs may include three legs that are identical in shape and size. The identical legs may simplify the fabrication and assembly process. FIGS. 1-4 show an example of legs 104*a-c* identical in shape and size, and FIG. 5 shows a detailed view of each leg in FIGS. 1-4. The identical legs may each have three sides that form a perimeter triangular shape. Each side may intersect two other sides at a corner of the top. For example, a first side 108 and a second side 110 may define a first corner 122, the second side 110 and a third side 112 may define a second corner 124, and the first side 108 and the third side 112 may define a third corner 126. In some embodiments, the first corner 122 may be an obtuse angle. According to some embodiments, the second corner 124 and the third corner 126 may be acute angles. According to some embodiments, the first corner 122 or the third corner 126 may be used to support the legs 104 on a floor.

Each side has a length that may be different from a length of another side. According to some embodiments, the first side 108 may have a length of at least about 18 inches, about 20 inches, about 22 inches, about 24 inches, about 26 inches, or about 28 inches. According to some embodiments, the first side 108 may have a length of at most about 40 inches, about 38 inches, about 36 inches, about 34 inches, about 32 inches, or about 30 inches. According to some embodiments, the first side 108 may have a length of about 18-40 inches, about 20-38 inches, about 22-36 inches, about 24-34 inches, about 26-32 inches, or about 28-30 inches.

The second side may have a length that is shorter than the other sides. According to some embodiments, the second side 110 may have a length of at least about 8 inches, about 10 inches, about 12 inches, about 14 inches, about 16 inches, or about 18 inches. According to some embodiments, the second side 110 may have a length of at most about 30 inches, about 28 inches, about 26 inches, about 24 inches, about 22 inches, or about 20 inches. According to some embodiments, the second side 110 may have a length of about 8-30 inches, about 10-28 inches, about 12-26 inches, about 14-24 inches, about 16-22 inches, or about 18-20 inches.

The third side may have a length that is longer than the other sides. According to some embodiments, the third side 112 may have a length of at least about 26 inches, about 28 inches, about 30 inches, about 32 inches, about 34 inches, or about 36 inches. According to some embodiments, the third side 112 may a length of at most about 46 inches, about 44 inches, about 42 inches, about 40 inches or about 38 inches. According to some embodiments, the third side 112 may have a length of about 26-46 inches, about 28-44 inches, about 30-42 inches, about 32-40 inches, or about 34-38 inches.

According to some embodiments, each identical leg may include one or more slots configured to engage with slots of another leg for interlocking the legs together. The one or more slots may be located on each side of each leg. For example, the first side 108 may include a first slot 114, the second side 110 may include a second slot 116, and the third side 112 may include a third slot 118 and a fourth slot 120. According to some embodiments, the slots may be rectangular in shape and extend from a perimeter of the leg towards an interior of the leg. According to some embodiments, the first slot 114 and the second slot 116 may extend towards an interior of the leg towards the third side 112, the third slot 118 may extend towards an interior of the leg towards the first side 108, and the fourth slot 120 may extend towards an interior of the leg towards the second side 110. According to some embodiments, the first slot 114 may extend from the first side 108 in a direction perpendicular to the first side 108, the second slot 116 may extend from the second side 110 in a direction perpendicular to the second side 110, the third slot 118 may extend from the third side 112 in a direction perpendicular to the first side 108, and the fourth slot 120 may extend from the third side 112 in a direction perpendicular to the second side 110. According to some embodiments, the first slot 114 extends further into the interior of the leg than the second slot 116 and the third slot 118 extends further into the interior of the leg than the fourth slot 120 and the first slot 114.

According to some embodiments, each slot may be bounded by three walls that form a channel and the channel is configured for receiving a slot of another leg. One of the walls may define a width of the slot and another wall may define a depth of the slot. According to some embodiments, the width of one slot may be at least about 0.6 inches, about 0.8 inches, or about 1 inch. According to some embodiments, the width of one slot may be at most about 2.5 inches, about 1 inches, or about 1.5. According to some embodiments, the width of one slot may be about 0.6-2.5 inches, about 0.8-1 inches, or about 1-1.5 inches.

According to some embodiments, the depth of each slot may be measured as the length of the longest wall of the slot that extends from the side that includes the slot towards an interior of the leg. For example, walls 114*a*, 116*a*, 118*a*, and 120*a* may respectively be the depth of the first slot 114, the second slot 116, the third slot 118, and the fourth slot 120. According to some embodiments, the third slot 118 may have the largest depth, the first slot 114 may have the second largest depth, the fourth slot 120 may have the second smallest depth, and the second slot 116 may have the smallest depth. According to some embodiments, a depth of one slot may be at least about 0.5 inches, about 1 inch, about 1.5 inches, or about 2 inches. According to some embodiments, the depth of one slot may be at most about 4.5 inches, about 4 inches, about 3.75 inches, or about 3.5 inches. According to some embodiments, the depth of one slot may be 0.5-4.5 inches, about 1-4 inches, about 1.5-3.75 inches, or about 2-3.5 inches.

According to some embodiments, the plurality of legs are configured to interlock with each other via slots in each leg.

The interlocked legs provides a stable base for the table top. According to some embodiments, each leg is configured to interlock with two other legs of the plurality of legs in one of two configuration. For example, the first slot 114 of one leg and the third slot 118 of another leg may be configured to interlock the legs together in the first configuration as shown in FIGS. 1, 2, 3A, and 4. In the first configuration, the second corner 124 of each leg may be configured to contact a floor, whereas the first corner 122 and the corner 126 may be configured to be spaced from the floor and adjacent to the table top 102. Additionally, the second slot 116 of one leg and the fourth slot 120 of another leg may be configured to interlock the legs together in a second configuration. In the second configuration, the third corner 126 of each leg may be configured to contact a floor, whereas the first corner 122 and the second corner 124 may be configured to be spaced from the floor and adjacent to the table top 102. An example of a second configuration is shown in FIGS. 6-8.

According to some embodiments, each leg may include one or more apertures (e.g., geometrical cutouts) to reduce the weight of each leg while maintaining structural stability to form a stable base for supporting the table top. These apertures may be spaced and shaped to achieve a lightweight structural leg. According to some embodiments, an aperture 128 may be spaced from the second side 110 and the third side 112 by at least about 1.5 inches, about 2 inches, or about 2.5 inches. According to some embodiments, an aperture 128 may be spaced from the second side 110 and the third side 112 by at most about 4.5 inches, about 4 inches, or about 3.5 inches. According to some embodiments, an aperture 128 may be spaced from the second side 110 and the third side 112 by about 1.5-4.5 inches, about 2-4 inches, or about 2.5-3.5 inches. According to some embodiments, an aperture 128 may be shaped like a triangle, square, rectangle, circle, or other geometric shapes. According to some embodiments, an aperture 128 may be a triangular shape that is similar to the triangular shape of the leg. According to some embodiments, each leg may include one or more apertures.

Figure 8B:
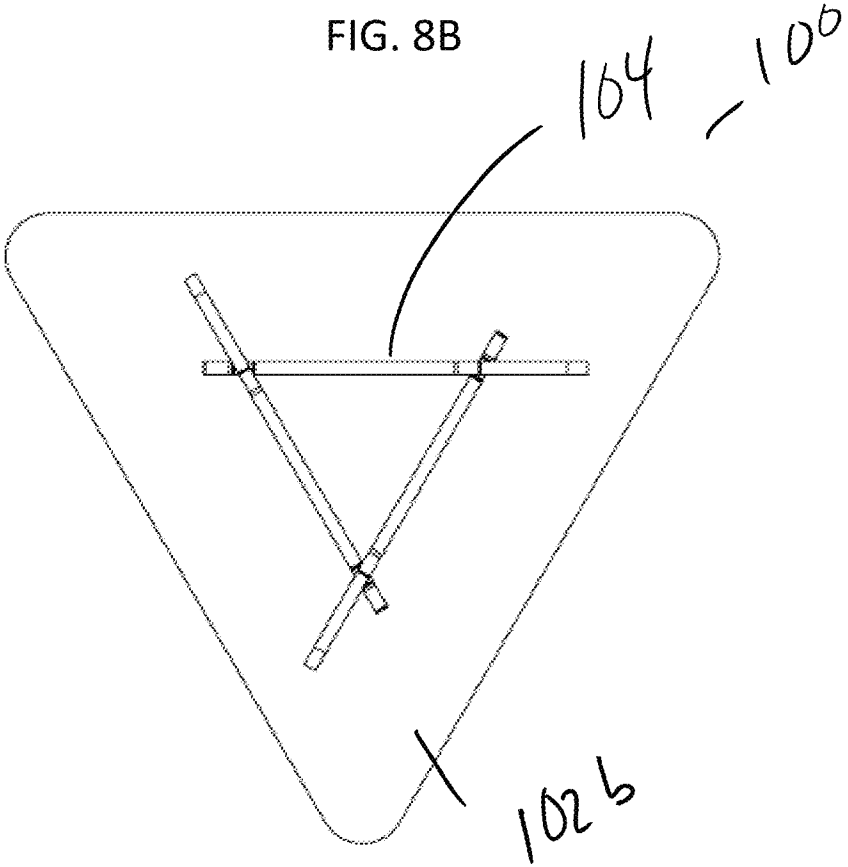
Figure 8A:
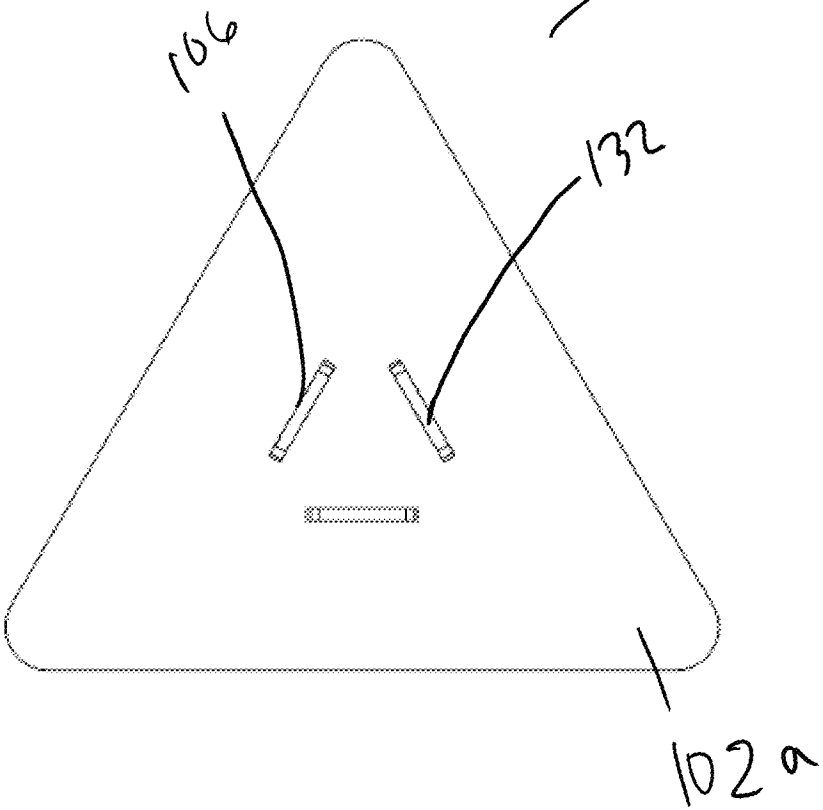

According to some embodiments, each leg of the plurality of legs may include a plurality of protrusions configured to engage the top so that the top is stabilized on the legs to form either the first configuration or the second configuration of the table. According to some embodiments, a first protrusion of the plurality of protrusions may be positioned on a first side of each leg to engage the top to form the first configuration and a second protrusion of the plurality of protrusions may be positioned on a second side to engage the top to form the second configuration. For example, the first side 108 and the second side 110 may include a protrusion along its perimeter configured to engage the table top 102. The first side 108 may include a first protrusion 130 positioned along the perimeter of the leg between the first slot 114 and the third corner 126. The first protrusions 130 of each leg engaged with the top 102 may be configured to form the first configuration of the table 100. An example of the first protrusions 130 engaging the top 102 is shown in FIG. 3A. Additionally, the second side 110 may include a second protrusion 132 positioned along the perimeter of the leg between the second slot 116 and the second corner 124. The second protrusions 132 engaged with the top 102 may be configured to form the second configuration. An example of the second protrusions 132 engaging the top 102 is shown in FIG. 8A.

According to some embodiments, the protrusions of each leg may extend away from an interior of the leg to engage the top. For example, the first protrusion 130 and the second protrusion 132 of each leg may extend away from an interior of the leg respectively from the first side 108 and the second side 110 at least by about 0.2 inches, about 0.4 inches, or about 0.6 inches. According to some embodiments, the first protrusion 130 and the second protrusion 132 of each leg may extend away from an interior of the leg respectively from the first side 108 and the second side 110 at most by about 1.2 inches, about 1 inch, or about 0.8 inches. According to some embodiments, the first protrusion 130 and the second protrusion 132 of each leg may extend away from an interior of the leg respectively from the first side 108 and the second side 110 by about 0.2-1.2 inches, about 0.4-1 inches, or about 0.6-0.8 inches. According to some embodiments, the first and second protrusions 130, 132 may have identical dimensions.

According to some embodiments, when assembled in the first configuration, the first protrusion of each leg engages the top by extending into the apertures of the top. In the exemplary first configuration shown in FIGS. 1-3, the protrusion 130 of each leg extends into the corresponding apertures 106 between the first surface 102*a* and the second surface 102*b* of the table top 102. According to some embodiments, when assembled in the second configuration, the second protrusion of each leg engages the top by extending into the apertures of the top. In the exemplary second configuration shown in FIGS. 6-8, the protrusion 132 of each leg extends into the corresponding apertures 106 between the first surface 102*a* and the second surface 102*b* of the table top 102. According to some embodiments, each protrusion 130, 132 may be configured to extend partially or completely through a corresponding aperture in the table top 102. According to some embodiments, the protrusions 130, 132 may extend passed the first surface 102*a* or the second surface 102*b* and be respectively flush with the second surface 102*a* or the first surface 102*b*.

Figure 6B:
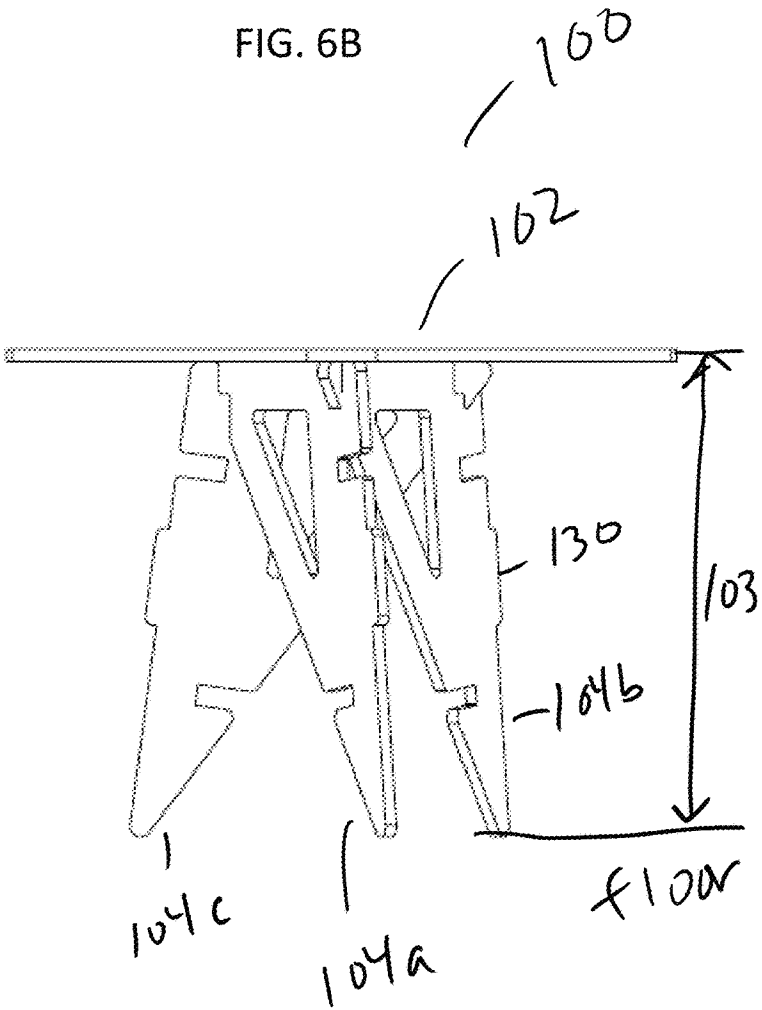
FIGS. 6A-B show side views of a table assembled in a second configuration according to some embodiments, FIGS. 7A-B respectively show a top perspective view and a bottom perspective view of a table assembled in a second configuration according to some embodiments, FIGS. 8A-B respectively show a top planar view and a bottom planar view of a table assembled in a second configuration according to some embodiments.
Figure 6A:
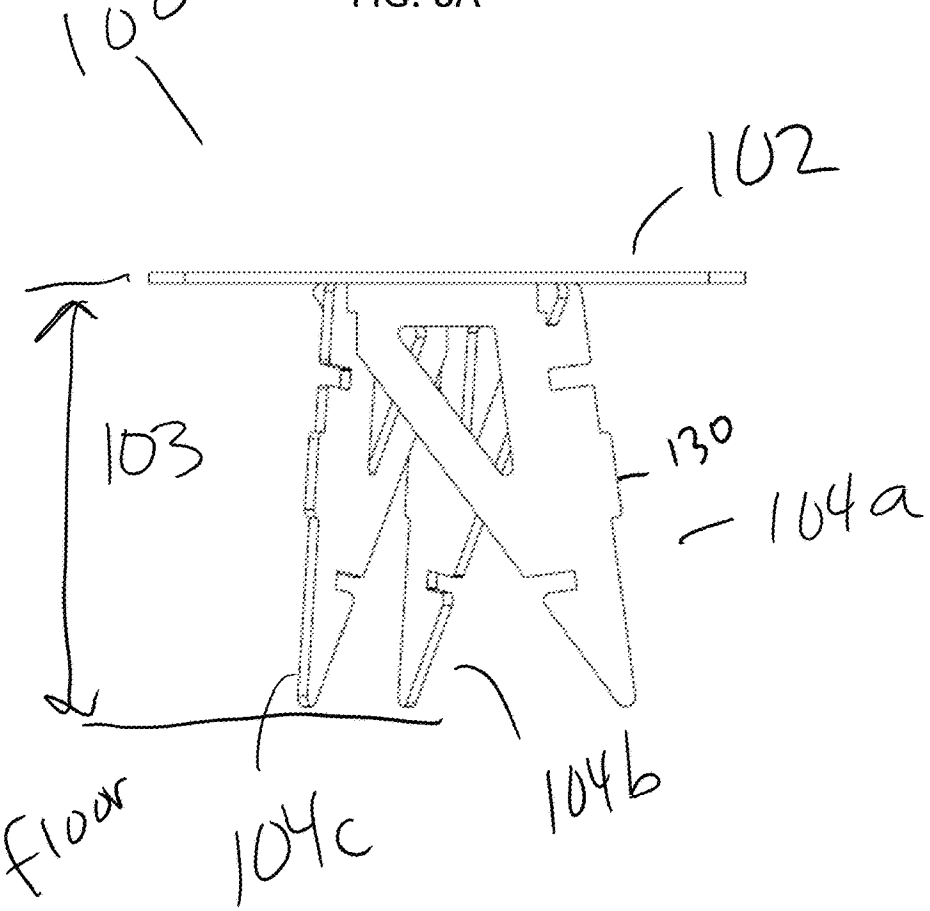
Figure 7B:
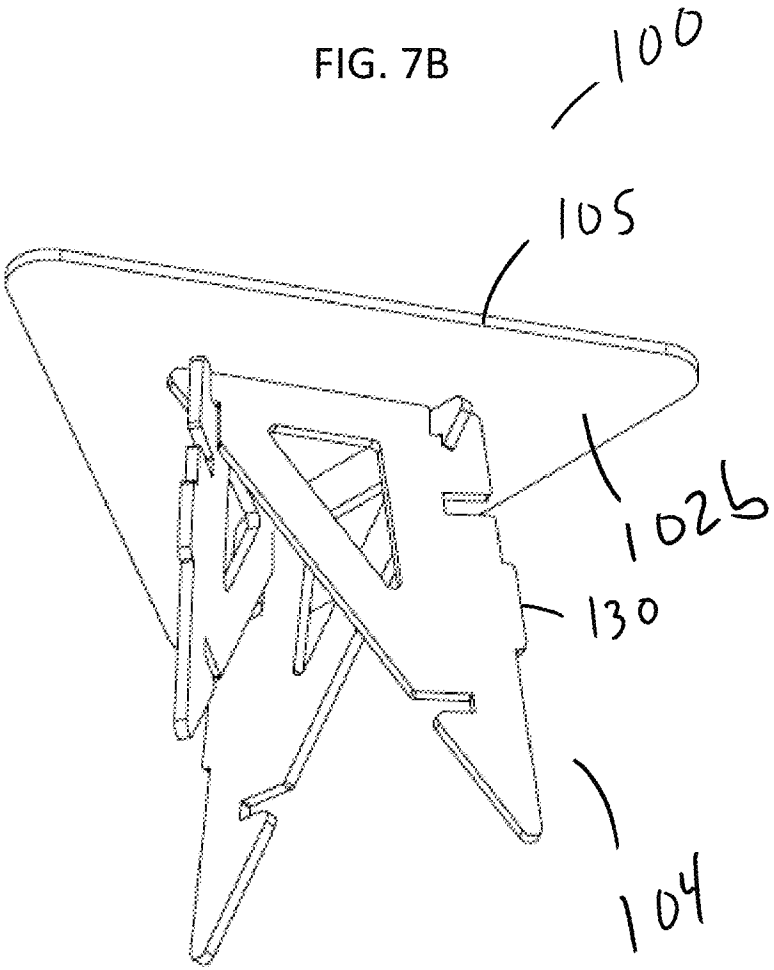
Figure 7A:
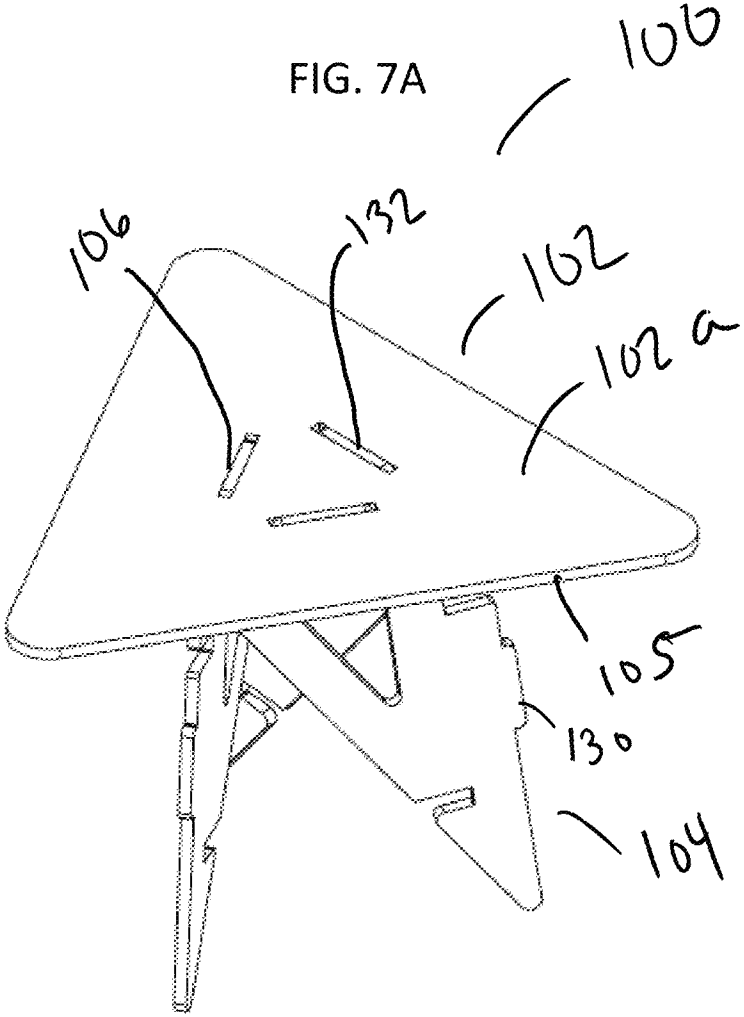
Figure 9:
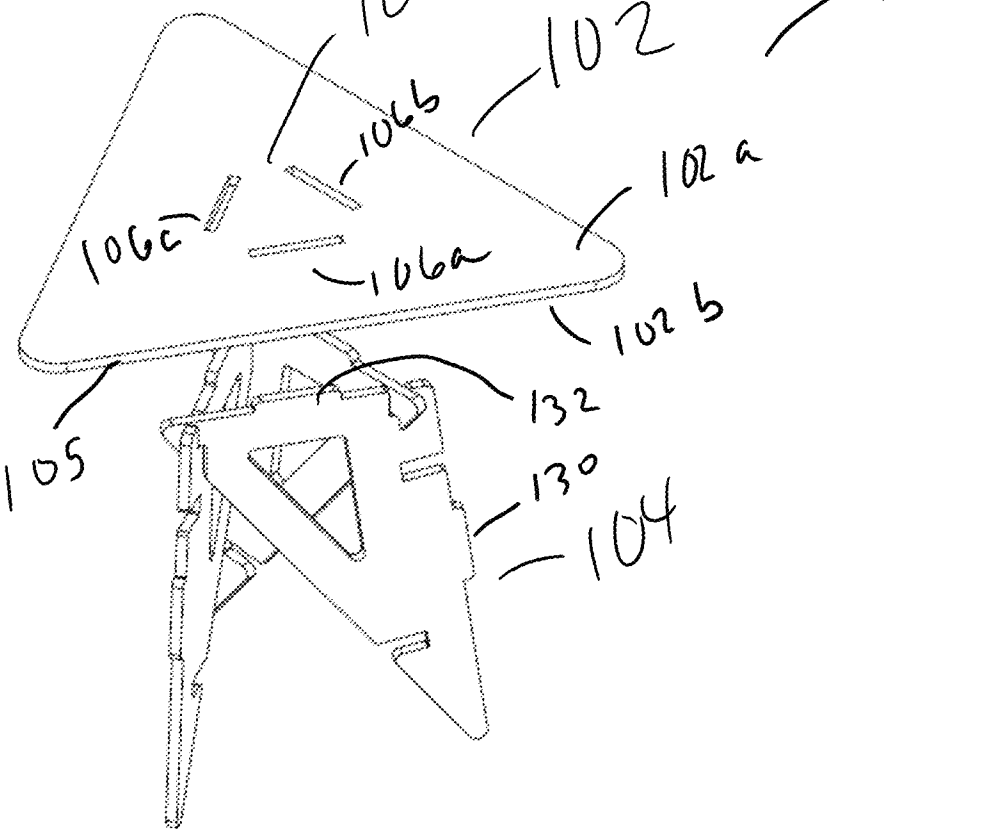
FIG. 9 shows a partial exploded view of a table in a second configuration.

According to some embodiments, the table may be assembled into a second configuration that has a table height different from the first configuration. FIGS. 6-8 show an example of table 100 assembled in the second configuration. In particular, FIGS. 6A and 6B show side views of table 100 in the second configuration, FIGS. 7A and 7B respectively show top and bottom perspective views of table 100 in the second configuration, and FIGS. 8A and 8B respectively show top and bottom planar views of table 100 in the second configuration. In the second configuration, the plurality of legs 104*a*, 104*b*, 104*c* that engage each other form a base for supporting the top 102 a second table height 103. In some embodiments, the second table height can be greater than the first table height. The second table height 103 may be a distance between the table top 102 assembled onto the plurality of legs and a surface, such as a floor or ground, that supports the plurality of legs. The top 102 may be assembled onto and disassembled from the base formed by the plurality of legs 104. For example, FIG. 9 shows a partial exploded view of the table 100 in which the top 102 is separated from the base.

According to some embodiments, the table may be assembled into either configuration or disassembled from either configuration. According to some embodiments, the table may be assembled into the first configuration, disassembled from the first configuration, and assembled into the second configuration. For example, a user of table 100 may change the configuration of the table from the first configuration to the second configuration, by disengaging the protrusion 130 of each leg from the apertures 106 of the top 102, disengaging the first slot 114 of each leg from the third slot 118 of another leg, orienting each leg to arrange the second slot 116 of each leg to engage the fourth slot 120 of another leg, engaging the second slot 116 of each leg with the fourth slot 120 of another leg, and mounting the table top 102 on the plurality of legs 104 such that the second protrusions 132 of the legs 104 extend into the plurality of apertures 106 in the table top.

According to some embodiments, the table may also be assembled into the second configuration, disassembled from the second configuration, and assembled into the first configuration. For example, a user of table 100 may change the configuration of the table from the second configuration to the first configuration by disengaging the protrusion 130 of each leg from the apertures 106 of the top 102, disengaging the second slot 116 of each leg from the fourth slot 120 of another leg, orienting each leg to arrange the first slot 114 of each leg to engage the third slot 118 of another leg, engaging the first slot 114 of each leg with the third slot 118 of another leg, and mounting the table top 102 on the plurality of legs 104 such that the first protrusions 130 of the legs 104 extend into the plurality of aperture 106 in the table top.

According to some embodiments, the table top and the plurality of legs may be made from a lightweight material, such as plywood. The lightweight materials allows for ease in transportation and quick table assembly and disassembly. According to some embodiments, the assembly/disassembly of table into/from the first configuration or second configuration does not require tools such as screwdrivers, hammers, latches, nuts, screws, or bolts. In some embodiments, all corners of the table, including top and legs, are rounded to provide a table configured to avoid potential user trauma associated with sharp edges. The rounded corners may also provide a table safe for children.

Figure 10B:
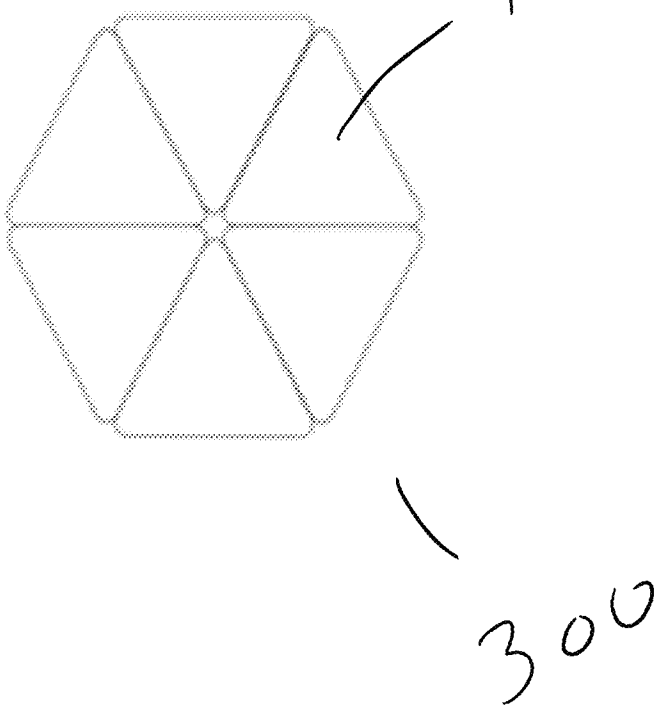
FIG. 10B shows a top view of a modular table shaped by six table modules.
Figure 10A:
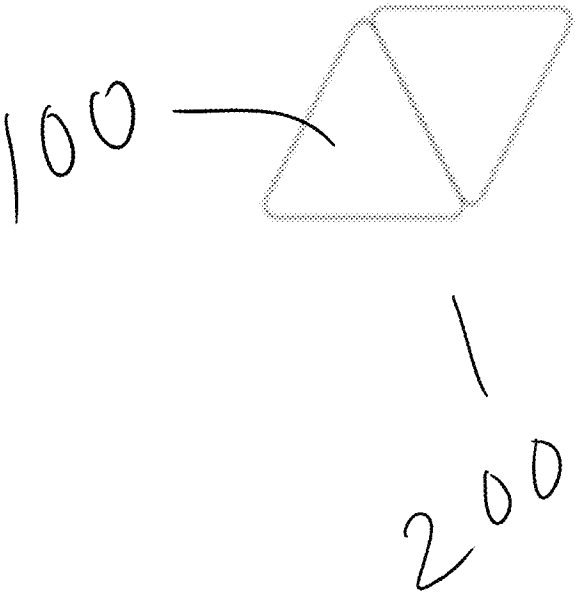
FIG. 10A shows a top view of a modular table shaped by two table modules.

According to some embodiments, the table may be used as a module for larger tables. For example, FIG. 10A shows two tables 100 as a module for a larger table 200 and FIG. 10B shows six tables 100 as a module for a larger table 300. According to some embodiments, the larger table may have a shape and size dependent on the number of smaller tables and the orientation of the tables relative to each other. For example, table 200 in FIG. 10A includes two modules of table 100 that form a rhomboid shape and table 300 in FIG. 10B includes six modules of table 100 that form a hexagonal shape.

According to some embodiments, the larger tables may have a table height that is based on whether each modular table (such as table 100) of the larger table (such as table 200, 300) is in the first configuration or in the second configuration. According to some embodiments, the larger tables (such as tables 200, 300) may include one or more tables in the first configuration and one or more tables in the second configuration.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A table comprising:

a top comprising a plurality of apertures; and a plurality of legs, each leg comprising:

a first side comprising a first protrusion and a first slot;

a second side comprising a second protrusion and a second slot; and a third side comprising a third slot and a fourth slot, wherein:

when the table is in a first configuration, the first protrusion of each leg engages with any aperture of the plurality of apertures of the top such that each first protrusion is engaged with an aperture that is different from another aperture engaged with another first protrusion and the first slot of each leg engages with the third slot of another leg, and when the table is in a second configuration, the second protrusion of each leg engages with any aperture of the plurality of apertures of the top such that each second protrusion is engaged with an aperture that is different from another aperture engaged with another second protrusion and the second slot of each leg engages with the fourth slot of another leg, wherein the table has a first height in the first configuration and a second height in the second configuration.

2. The table of claim 1, wherein the top comprises a first surface and a second surface, and wherein the plurality of apertures extends from the first surface to the second surface through the top.

3. The table of claim 2, wherein in the second configuration, the second protrusion of each leg extends through any aperture of the plurality of apertures from the first surface to the second surface of the top.

4. The table of claim 1, wherein in the first configuration, the first protrusion of each leg extends through any aperture of the plurality of apertures from the first surface to the second surface of the top.

5. The table of claim 1, wherein the first slot and the second slot extend towards the third side, the second slot extends towards the third side, the third slot extends towards the first side, and the fourth slot extends towards the second side.

6. The table of claim 5, wherein the first slot extends from the first side in a direction perpendicular to the first side, the second slot extends from the second side in a direction perpendicular to the second side, the third slot extends from the third side in a direction perpendicular to the first side, and the fourth slot extends from the third side in a direction perpendicular to the second side.

7. The table of claim 1, wherein the plurality of apertures comprises a number of apertures and the plurality of legs comprises a number of legs equal to the number of apertures.

8. The table of claim 1, wherein the top has a triangular shape.

9. The table of claim 1, wherein the apertures of the plurality of apertures are identical in shape and size.

10. The table of claim 1, wherein the plurality of apertures comprises three apertures.

11. The table of claim 1, wherein the legs of the plurality of legs have a triangular shape.

12. The table of claim 1, wherein the plurality of legs comprises three legs.

13. The table of claim 1, wherein the legs of the plurality of legs are identical in shape and size.

14. The table of claim 1, wherein the top is plywood.

15. A table system comprising a plurality of tables, each table comprising:

a top comprising a plurality of apertures; and a plurality of legs, each leg comprising:

a first side comprising a first protrusion and a first slot;

a second side comprising a second protrusion and a second slot; and a third side comprising a third slot and a fourth slot, wherein:

when the table is in a first configuration, the first protrusion of each leg engages any aperture of the plurality of apertures of the top such that each first protrusion is engaged with an aperture that is different from another aperture engaged with another first protrusion and the first slot of each leg engages the third slot of another leg, and when the table is in a second configuration, the second protrusion of each leg engages any aperture of the plurality of apertures of the top such that each second protrusion is engaged with an aperture that is different from another aperture engaged with another second protrusion and the second slot of each leg engages the fourth slot of another leg, wherein the table has a first height in the first configuration and a second height in the second configuration.

16. The system of claim 15, wherein each top of the plurality of tables comprises a first shape, wherein the first shape is circular, triangular, rectangular, or another polygonal shape.

17. The system of claim 16, wherein the table system is configured to form a second shape based on the first shape and an orientation of each top of the plurality of tables.

* * * * *